US005237141A

United States Patent [19]

Yoshino et al.

[11] Patent Number: 5,237,141

[45] Date of Patent: Aug. 17, 1993

[54] HIGH FREQUENCY HEATING APPARATUS AND ELECTROMAGNETIC WAVE DETECTOR FOR USE IN HIGH FREQUENCY HEATING APPARATUS

[75] Inventors: Koji Yoshino, Soraku; Takashi Kashimoto, Nara; Kimiaki Yamaguchi, Nara; Masato Yota, Nara; Shinichi Sakai, Yamatokoriyama; Satomi Moriyama, Nara, all of Japan

[73] Assignee: Matsushita Electric Industrial Co., Ltd., Osaka, Japan

[21] Appl. No.: 953,780

[22] Filed: Sep. 30, 1992

Related U.S. Application Data

[63] Continuation of Ser. No. 728,244, Jul. 10, 1991.

[30] Foreign Application Priority Data

| | | | |
|---|---|---|---|
| Jul. 17, 1990 | [JP] | Japan | 2-188953 |
| Jul. 17, 1990 | [JP] | Japan | 2-188955 |
| Jul. 17, 1990 | [JP] | Japan | 2-188956 |
| Jul. 18, 1990 | [JP] | Japan | 2-191181 |
| Jul. 18, 1990 | [JP] | Japan | 2-191182 |

[51] Int. Cl.[5] ..... H05B 6/68

[52] U.S. Cl. ..... 219/10.55 B; 219/10.55 F; 219/10.55 E

[58] Field of Search ..... 99/DIG. 14

[56] References Cited

U.S. PATENT DOCUMENTS

| | | | |
|---|---|---|---|
| 3,778,717 | 12/1973 | Okoshi et al. | 343/775 |
| 4,009,359 | 2/1977 | Tallmadge et al. | 219/10.55 B |
| 4,049,938 | 9/1977 | Ueno | 219/10.55 R |
| 4,211,911 | 7/1980 | Dehn | 219/10.55 F |
| 4,262,255 | 4/1981 | Kokei et al. | 324/96 |
| 4,367,388 | 1/1983 | Ishihara et al. | 219/10.55 B |
| 4,442,590 | 4/1984 | Stockton et al. | 29/571 |
| 4,520,250 | 5/1985 | Ishihara et al. | 219/10.55 B |
| 4,587,393 | 5/1986 | Ueda et al. | 219/10.55 B |
| 4,631,473 | 12/1986 | Honda | 324/95 |
| 4,853,703 | 8/1989 | Murakami et al. | 343/700 MS |
| 4,871,891 | 10/1989 | Steers et al. | 219/10.55 B |

FOREIGN PATENT DOCUMENTS 0461269 12/1990 European Pat. Off. .

OTHER PUBLICATIONS

Patent Abstracts of Japan, vol. 014, No. 102 (E-894) 23 Feb. 1990 & JP-A-01 304 688 (Matsushita Electric Industrial Co., Ltd.) 8 Dec. 1989.

*Primary Examiner*—Bruce A. Reynolds
*Assistant Examiner*—Tuan Vinh To
*Attorney, Agent, or Firm*—Wenderoth, Lind & Ponack

[57] ABSTRACT

A high frequency heating apparatus and an electromagnetic wave detector for use in the high frequency heating apparatus, are so arranged to estimate the cooking or thawing state of a food article placed in a heating chamber through detection of microwaves within the heating chamber. By devising a position of an antenna and a method of processing signals of the microwaves as detected, stably and reliable microwave detection becomes possible.

20 Claims, 16 Drawing Sheets

HIGH FREQUENCY HEATING APPARATUS AND ELECTROMAGNETIC WAVE DETECTOR FOR USE IN HIGH FREQUENCY HEATING APPARATUS

This application is a continuation of now abandoned application, Ser. No. 07/728,244, filed Jul. 10, 1992.

BACKGROUND OF THE INVENTION

The present invention generally relates to a high frequency heating arrangement, and more particularly, to a high frequency heating apparatus or microwave oven or the like, which is capable of automatizing cooking, for example, in thawing food articles, etc., by controlling functioning of the apparatus through estimation of a state of the food article based on detection of the state of electromagnetic waves within a heating chamber, and also to an electromagnetic wave detector to be used for such a high frequency heating apparatus.

Recently, there has been a stronger tendency toward automatization of cooking, for example, by automatic thawing of a food article through utilization of a high frequency heating apparatus.

In connection with the above, the conventional practice has been such that an operator inputs the weight of the food article by keys (referred to as "time-auto"), or the operator determines the weight of the food article through employment of a weight sensor which automatically detects the weight thereof, whereby a heating time is preliminarily set for each weight of the food article. Moreover, there has also been proposed another arrangement in which an antenna is disposed within a heating chamber to determine a proper heating time by utilizing the characteristic that the microwave power detected by the antenna without being absorbed by the food article varies inversely with the weight of the food article, for example, in Japanese Patent Laid-Open Publication Tokkaisho No. 52-2133, the construction of such an arrangement is briefly described hereinbelow with reference to FIG. 1.

In the known arrangement of FIG. 1, a frozen food article 2 is placed in a heating chamber 1, and electromagnetic waves i.e. microwaves represented by an arrow 4 are applied thereto from a microwave radiating portion 3. In this case, some part 5 of the microwaves 4 not absorbed by the food article 2 is received by an antenna 6 disposed within the heating chamber 1, and after being detected by a detecting circuit 7, fed to a control section 8. Since the amount of the microwaves as detected by the antenna 6 inversely varies with the weight of the food article 2, the weight of the food article 2 may be detected conversely, thus making it possible to set an optimum heating time.

However, the conventional detecting means as referred to above has various problems. In the first place, when a weight sensor is used, there has been such a disadvantage that the finished state tends to scatter due to the influence of the weight of a dish or container employed.

Meanwhile, in the case where the antenna is employed, the detection level tends to largely vary according to the antenna construction, the detection circuit construction, fitting accuracy therebetween the influence of any external electromagnetic field, etc., thus resulting in extremely unstable factors for determining a subsequent heating sequence and consequently, there is a problem in that an optimum finished state, can not be achieved.

SUMMARY OF THE INVENTION

Accordingly, an essential object of the present invention is to provide a high frequency heating apparatus in which control of the apparatus by the detection of the state of electromagnetic waves through employment of an antenna and a detecting circuit is effected extremely stably to provide an optimum finished cooking state.

Another object of the present invention is to provide an electromagnetic wave detector which is indispensable for achieving the high frequency heating apparatus of the above described type.

In accomplishing these and other objects, according to one aspect of the present invention, there is provided a high frequency heating apparatus which includes a heating chamber for accommodating a food article to be heated therein, a microwave radiating means for radiating microwave energy to heat the food article, an antenna means provided on a top portion of said heating chamber for receiving part of the microwave energy within said heating chamber, a detecting circuit for detecting the microwave energy received by said antenna means, and a control section for controlling various functions of said high frequency heating apparatus in accordance with an output from said detecting circuit.

In a second aspect of the present invention, the high frequency heating apparatus includes a heating chamber for accommodating a food article to be heated therein, a microwave radiating means for radiating microwave energy to heat the food article, an antenna means provided in the vicinity of an opening formed in a wall of said heating chamber for receiving part of the microwave energy within said heating chamber, a detecting circuit for detecting the microwave energy received by said antenna means, and a control section for controlling various functions of said high frequency heating apparatus in accordance with an output from said detecting circuit. The high frequency heating apparatus is so arranged that leakage power in the vicinity of said opening, said antenna means and said detecting circuit becomes less than 1/10 of a rated power of parts constituting said detecting circuit in a state where said antenna means and said detecting circuit are actually mounted.

In a third aspect of the present invention, the high frequency heating apparatus includes a heating chamber for accommodating a food article to be heated therein, a microwave radiating means for radiating microwave energy to heat the food article, a power source for supplying electric power to said microwave radiating means, an antenna means for receiving part of the microwave energy within said heating chamber, a detecting circuit for detecting the microwave energy received by said antenna means, a smoothing circuit for smoothing an output of said detecting circuit, an amplifying section for amplifying an output of said smoothing circuit, and a control section for controlling various functions of said high frequency heating apparatus in accordance with by an output from said amplifying section.

In a fourth aspect of the present invention, the high frequency heating apparatus includes a heating chamber for accommodating a food article to be heated therein, a microwave radiating means for radiating microwave energy to heat the food article, an antenna means for receiving part of the microwave energy within said heating chamber, a detecting circuit having micro-strip lines and chip parts including at least a diode, etc. for detecting the microwave energy received by said antenna means, and a control section for controlling various functions of said high frequency heating apparatus in accordance with an output from said detecting circuit.

In a fifth aspect of the present invention, the high frequency heating apparatus includes a heating chamber for accommodating a food article to be heated therein, a microwave radiating means for radiating microwave energy to heat the food article, an antenna means for receiving part of the microwave energy within said heating chamber, a detecting circuit for detecting the microwave energy received by said antenna means, through employment of a Schottky barrier diode, and a control section for controlling various functions of said high frequency heating apparatus in accordance with an output from said detecting circuit.

Further, in a sixth aspect of the present invention, there is provided an electromagnetic wave detector for use in the high frequency heating apparatus, which includes a two-sided substrate prepared by applying copper foils onto opposite faces of a substrate material, and an antenna means for receiving electromagnetic waves, and a detecting circuit having micro-strip lines and chip parts including at least a diode provided on said two-sided substrate.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
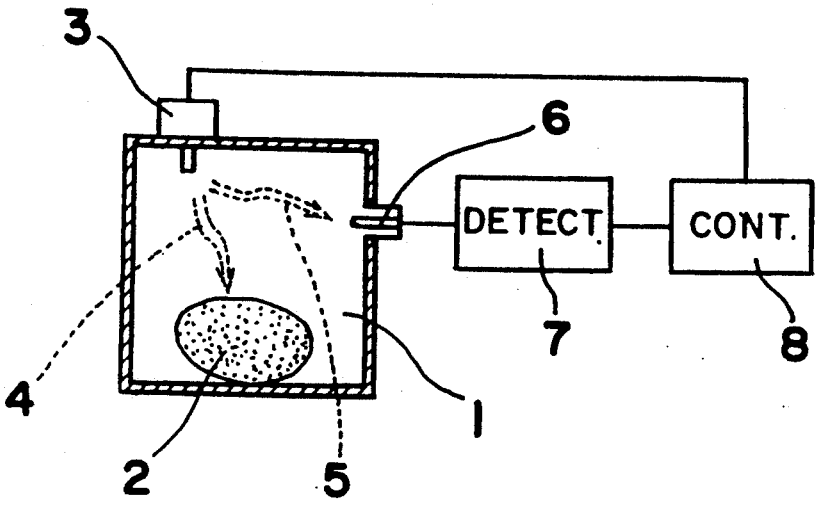
Fig. 1 PRIOR ART
FIG. 1 is a schematic diagram showing the general construction of a conventional high frequency heating apparatus (already referred to)

Before the description of the present invention proceeds, it is to be noted that like parts are designated by like reference numerals throughout the accompanying drawings.

Figure 2:
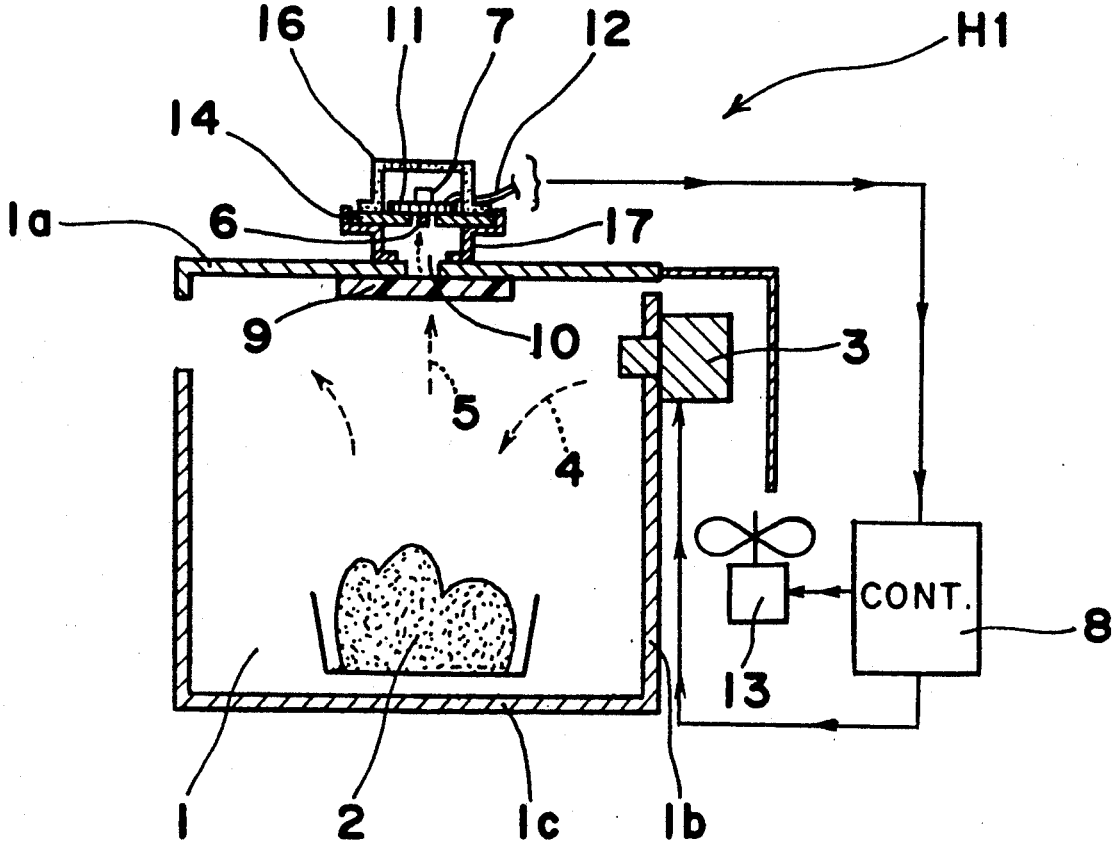
FIG. 2 is a diagram showing the general construction of a high frequency heating apparatus according to one preferred embodiment of the present invention.

Referring now to the drawings, there is shown in FIG. 2, a high frequency heating apparatus H1 according to one preferred embodiment of the present invention, which generally includes a heating chamber 1 defined by a top wall 1*a*, side walls 1*b* and a bottom wall 1*c* for accommodating a food article 2 to be heated therein, a microwave radiating means 3 i.e. a magnetron or the like, mounted on one of the side walls 1*b* for directing microwave energy to the food article 2 for heating, an antenna 6 provided on the top wall la of the heating chamber 1 for receiving part of the microwave energy within said heating chamber 1, a detecting circuit 7 coupled to the antenna 6 for detecting as elastic energy the microwave energy received by the antenna 6, and a control section 8 for controlling various functions of the heating apparatus based on an output from said detecting circuit 7.

By the above arrangement, upon turning on a power source (not particularly shown), electromagnetic waves i.e. microwaves indicated by the arrow 4 are radiated from the microwave radiating means 3 toward the food article 2 placed in the heating chamber 1. In this case, some portion 5 of the microwaves 4 not absorbed by the food article 2 passes through an aperture 10 formed on the top wall 1*a* of the heating chamber 1 via an aperture cover 9 of a resin material provided on said opening 10, and is received by the antenna 6, made of a copper foil provided on a printed circuit board 11 and disposed on the top wall 1*b* above said aperture 10 as will be described more in detail later, so as to be subsequently transmitted for detection to the detecting circuit 7 provided on the reverse face of the printed circuit board 11, and thereafter, sent to the control section 8 via leads 12 as an output of the detection circuit 7.

According to the detected amount of microwave energy, the control section 8 checks the state of the food article 2, and determines the optimum thawing time, thereby controlling the functioning of the microwave radiating means 3 and a fan 13 for cooling the microwave radiating means 3.

Referring to an exploded, perspective view of FIG. 3, the construction in the vicinity of the detecting circuit 7 will be described more in detail below.

Figure 3:
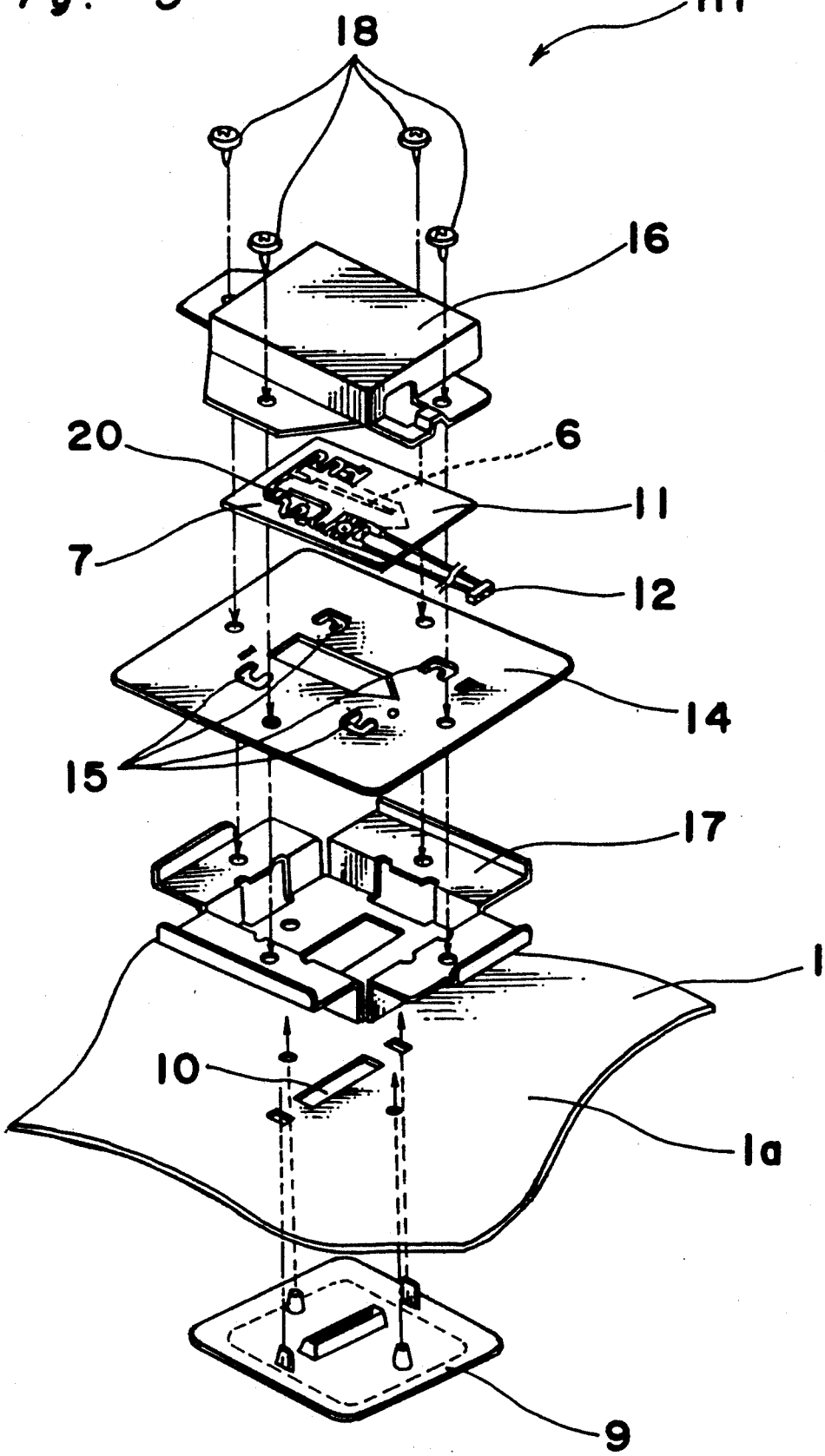
FIG. 3 is an exploded perspective view showing the construction of essential portions of the high frequency heating apparatus according to the present invention.

In FIG. 3, showing one example as to how the detecting circuit 7 and the antenna 6 are mounted on the top wall 1*a* of the heating chamber 1, the printed circuit board 11 having the detecting circuit 7 and the antenna 6 on upper and lower faces thereof has its grounding face, soldered to four soldering projections 15 on a metallic plate 14, while a cover plate 16 having a rectangular cubic box-like portion and folded edges with screw openings is applied thereover for shielding of microwaves, and fixed to a metallic support member 17, which is fixed by spot-welding to the top wall 1*a* of the heating chamber 1, by means of set screws 18 extended through the screw openings of the cover plate 16 so as to be threaded into corresponding threaded holes of the support member 17. The opening cover 9 of resin material for covering the opening 10 in the top wall 1*a* is fixed to the under face of said top wall through engagement of projections formed on said opening cover 9 and corresponding holes in the top wall 1*a*.

By the above construction, the printed circuit board 11 and consequently, the detecting circuit 7, is positively grounded by soldering to the metallic plate 14, with said metallic plate 14 and the metallic support member 17 being fully short-circuited, while the metallic support member 17 is perfectly short-circuited to the wall 1*a* of the heating chamber 1 by welding. Therefore, not only is high positional accuracy achieved for the mounting of parts, with positive grounding therebetween, but any stress to the detecting circuit may be suppressed, since the stress caused by the screw tightening may be absorbed by the metallic plate 14.

As the size of the rectangular shape opening 10 is reduced, the detection circuit 7 input is made smaller. Further, the input level is also varied by the height of the metallic support members 17 and the shape of the antenna 6. Accordingly, the configurations of the opening 10, metallic support member 17, and antenna 6 should be selected to achieve the optimum input.

Figure 4:
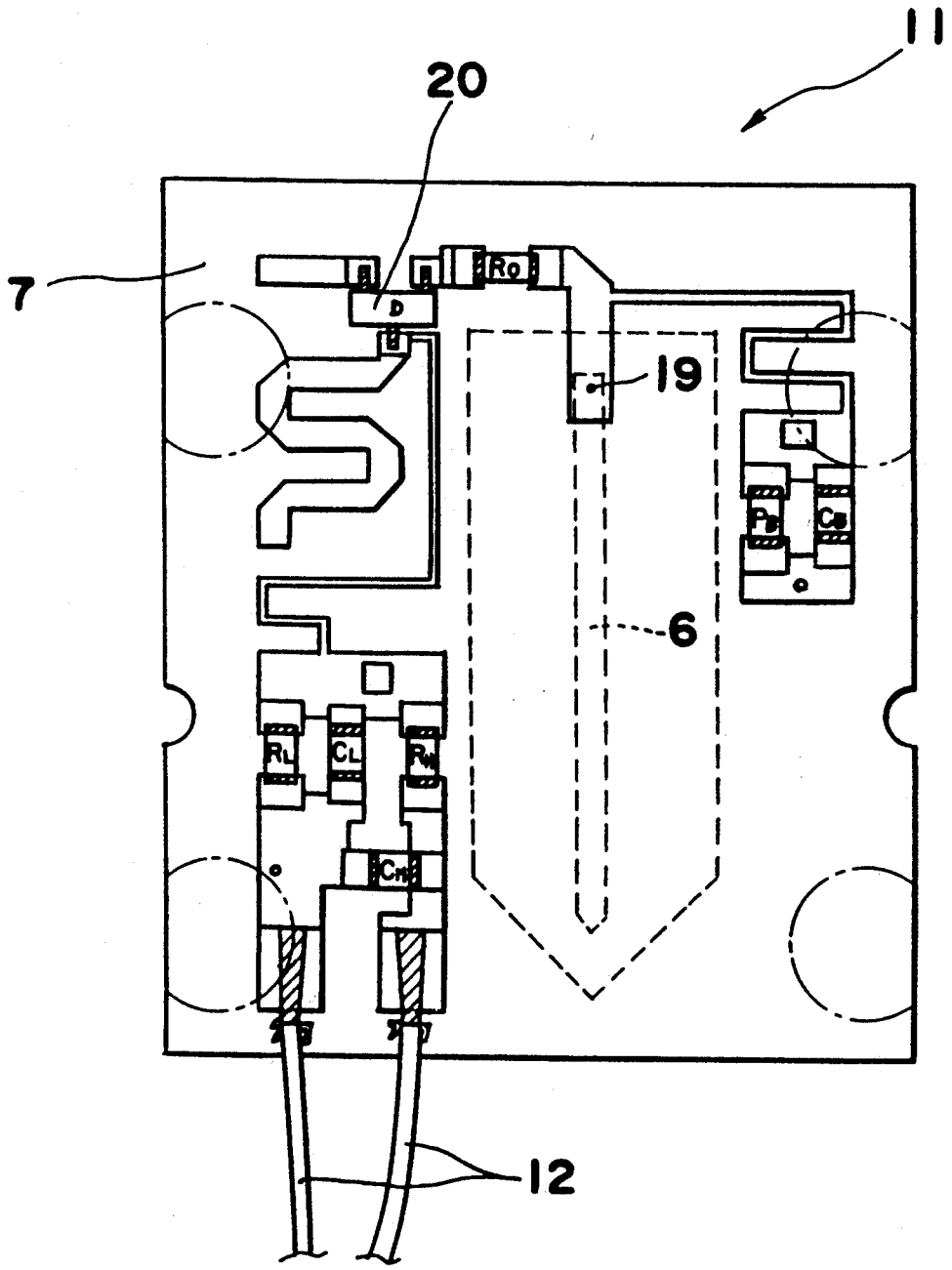
FIG. 4 is a top plan view showing on an enlarged scale, one embodiment for an antenna means and a detecting circuit which may be employed in the arrangement of FIG. 3.

FIG. 4 shows a top plan view of one example of the printed circuit board 11 as viewed from the side of the detecting circuit 7. In FIG. 4, the dashed lines represent patterns at the reverse face of the printed circuit board 11, while one-dot one-dash circles denote patterns at the reverse face without any resist (i.e. the grounding portions to be soldered to the metallic plate 14 as stated earlier with reference to FIG. 3). Microwaves as detected by the antenna 6 are led into the detecting circuit 7 via a through-hole 19 extending through the printed circuit board 11 so as to be detected by said detecting circuit 7 constituted by chip component parts such as a Schottky barrier diode 20, etc. and micro-strip lines, and thus, signals in the form of D.C. current are transmitted through the lead lines 12.

Figure 5:
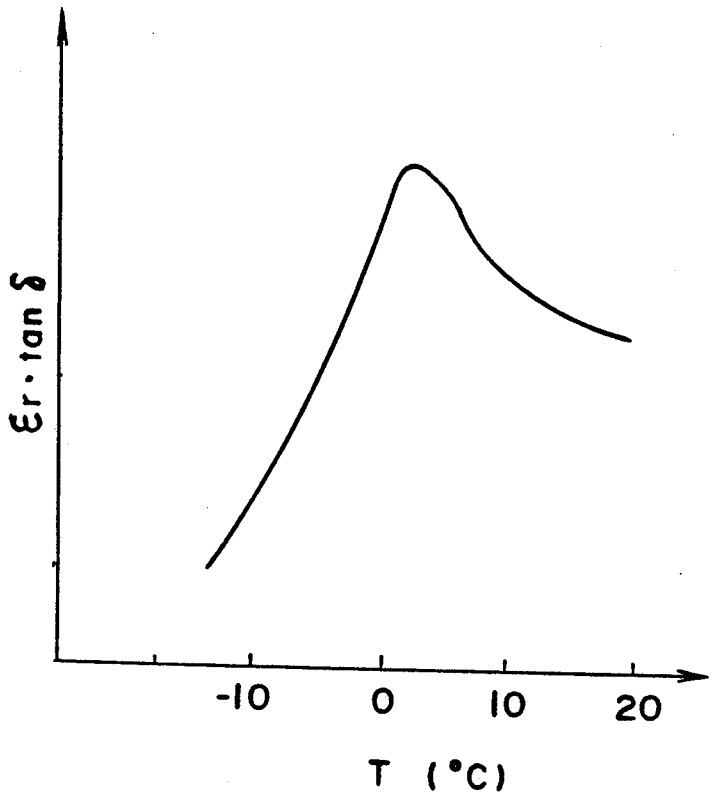
FIG. 5 is a characteristic diagram showing a relation between the temperature of a food article and degree of absorption of electromagnetic waves.
Figure 6:
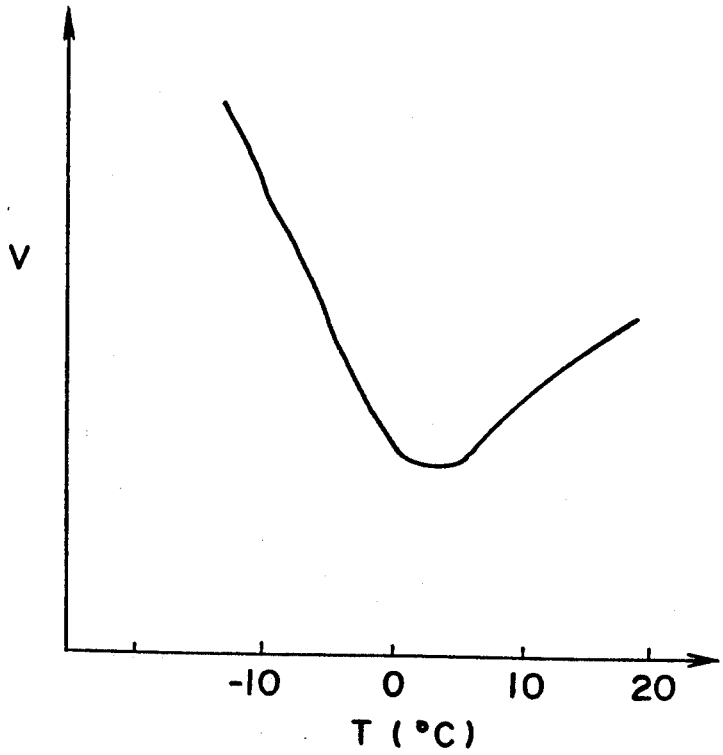
FIG. 6 is a characteristic diagram showing a relation between ideal food article temperatures and detecting circuit outputs.
Figure 7:
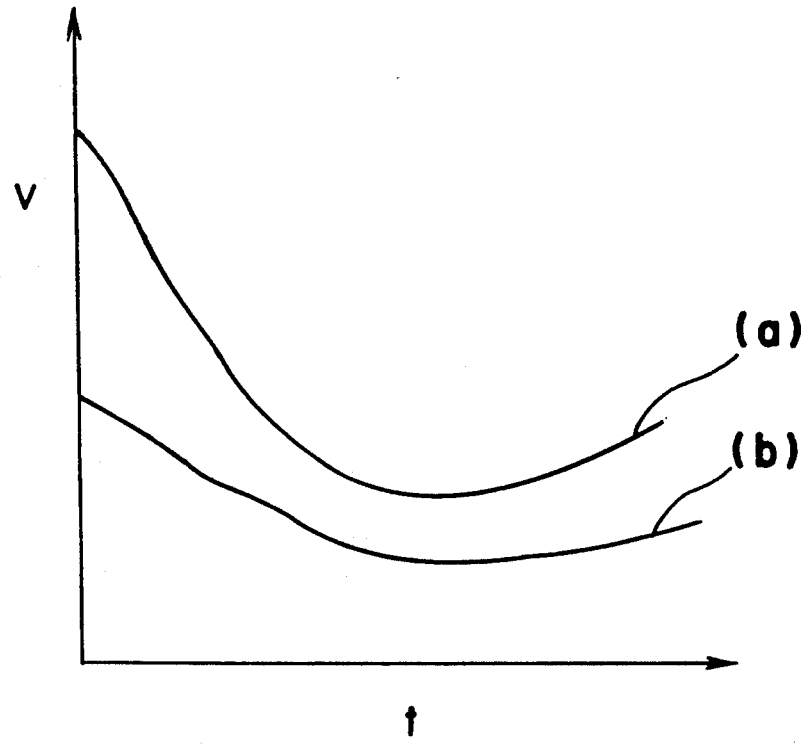
FIG. 7 is a characteristic diagram showing a relation between a heating time according to food articles and detecting circuit outputs.

Referring further to characteristic diagrams of FIGS. 5 to 7 showing principles for detection of food article thawing in the high frequency heating apparatus according to the present invention, the product of specific dielectric constant Er and dielectric loss tan 8 varies as in FIG. 5 when a food article is uniformly heated and simultaneously raised in temperature on the whole. In FIG. 5, the abscissa shows the temperatures T of the food article, and the ordinate denotes Er·tan δ, which is an index indicating how the food article is capable of absorbing microwaves, and in the diagram, it is indicated that the microwaves are not readily absorbed during freezing, but are easily absorbed in the vicinity of 0° C. In other words, the microwaves detected by the antenna without being absorbed by the food article are increased during freezing, but decreased in the vicinity of 0° C. From this, the diagram of FIG. 6 is obtained, in which the temperature T of the food article are plotted in the abscissa, and the output V of the detecting circuit, in the ordinate. As is seen from FIG. 6, in the case where the food article shows a uniform temperature rise, it appears that thawing detection is possible at an inflection point of the detection output. In the actual case, however, heating by the high frequency heating apparatus is not uniform, with portions where microwaves are concentrated and other portions where microwaves are not concentrated being combined, and therefore, in the resultant waveform, a number of curves as in FIG. 6 overlap each other, with the thawing not being completed at the inflection point at all times.

Accordingly, what are actually effective are the initial value of the detecting circuit output and initial variation rate. The initial value is generally inversely proportional to the weight of the food article, and for example, in the case of a small amount of the food article, there is little absorption of microwaves, with a large initial detecting circuit output, whereas in the case of a large amount of the food article, there is a large absorption of microwaves, with a small initial detecting circuit output. Meanwhile, in the case of a food article at a low temperature (−20° C.), the initial variation rate of the detecting circuit output is large, whereas in the food article at a medium temperature (−10° C.), the initial variation rate of the detecting circuit output tends to be small.

In the diagram of FIG. 7 showing a typical example, time t is plotted in the abscissa, while the detecting circuit output V is shown in the ordinate, and a curve (a) represents the smaller food article at the low temperature, and another curve (b) denotes the larger food article at the medium temperature.

Figure 8:
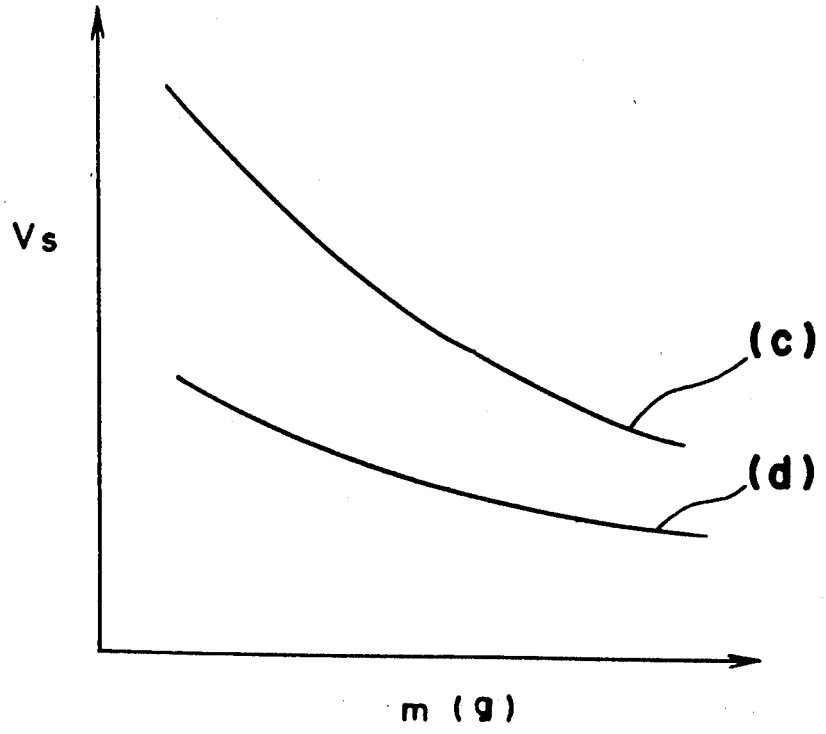
FIG. 8 is a characteristic diagram showing a relation between weights of the food article and detecting circuit outputs.

Based on the principles as described so far, correlation between the weight m and initial output Vs is obtained, with the initial output variation rate being set as a parameter as shown in FIG. 8, thereby to effect a weight judgement and initial temperature judgement of the food article. In FIG. 8, a curve (c) relates to the low temperature food article with a large variation rate, while another curve (d) denotes the medium temperature food article with a small variation rate. Needless to say, it is so arranged that, by effecting cooking, with the optimum heating time being set per weight and initial temperature in the control section 8, extremely stable thawing detection has been realized as compared with a weight sensor or the like which may involve erroneous detection caused by the weight of a dish and the like employed.

Figure 9:
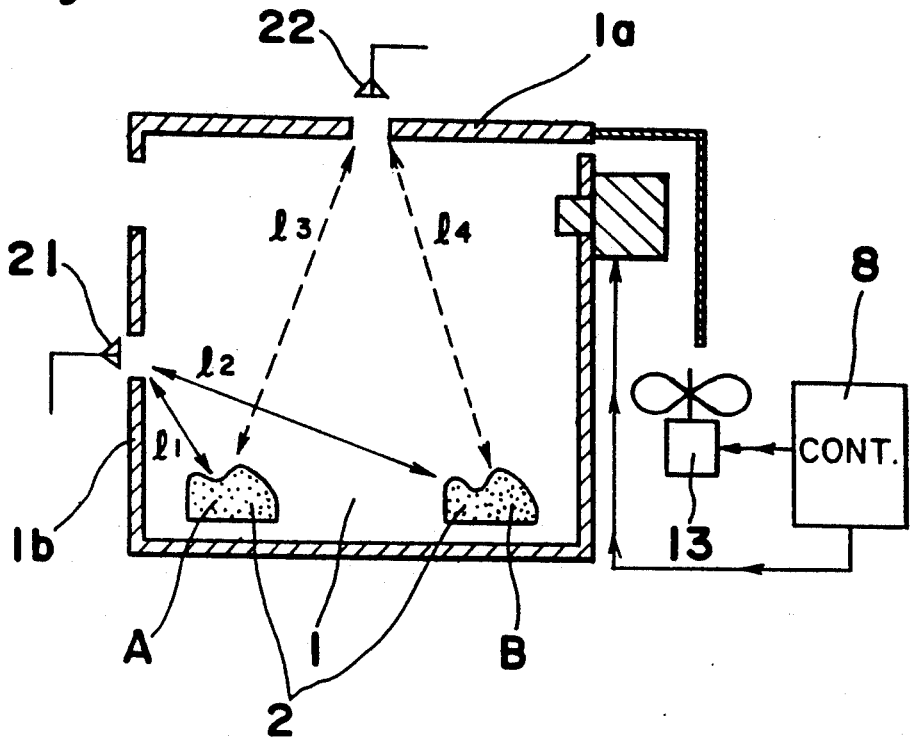
FIG. 9 is a schematic side sectional view of a high frequency heating apparatus for explaining a relation between the antenna fixing position and food article position.

Referring further to FIG. 9, a relation among the fixing position of the antenna, placing of the food article, and output of the detecting circuit will be described hereinafter.

FIG. 9 shows an example of a high frequency heating apparatus in which antennas 21 and 22 are disposed on one side wall 1*b* and on the top wall 1*a*. For the side wall antenna 21, if the food article 2 is placed at side portions as at A and B within the heating chamber 1, an extremely large difference may result in the detected amount. More specifically, within the heating chamber 1, since microwaves are complicatedly mixed, and absorbed into the food article 2 to a certain extent if such a food article 2 is so placed, microwave distribution in the vicinity of the food article 2 is still more disturbed. Accordingly, although the microwaves within the heating chamber 1 may be totally detected when the food article 2 is at the position B, the detected amount becomes unreliable if the food article 2 is located at the position A, since the microwaves in the vicinity of the side antenna 21 are disturbed. This is attributable to the fact that there is a large difference between the distance l1 from the side wall antenna 21 to the food article 2 at the position A and the distance l2 from said antenna 21 to the food article 2 at the position B, ($l1<l2$).

On the other hand, when the top wall antenna 22 is disposed on the top wall la of the heating chamber 1, since distances l3 and l4 from the top wall antenna 22 to the food articles 2 at the positions A and B are close to or approximately equal to each other ($l3 \approx l4$), the microwaves within the heating chamber 1 can be totally detected at any time. Furthermore, since the food article generally has a size or dimension which is long in a lateral direction (i.e. horizontal direction) and short in a longitudinal direction (i.e. vertical direction), the top wall is the best as the antenna fixing position.

The high frequency heating apparatus H1 according to the embodiment described so far with reference to FIGS. 2 to 4 has the effects as summarized hereinbelow.

Since the antenna 6 and the detecting circuit 7 are covered by the metallic plate 14, metallic cover plate 16, metallic support member 17 and the wall surface of the heating chamber 1, etc., there are no leakage of microwaves toward the outer sides or mixing of noises from the outer side, and thus, stable detecting performance may be achieved.

Owing to the arrangement that the antenna 6 is provided in the vicinity of the opening 10 so as to be protected by the opening cover 9, the antenna 6 is not directly hit by scattering matters from the food article 2, and thus, causes of errors such as dielectric constant variation, etc. around the antenna 6 caused by food article waste can be advantageously eliminated.

Similarly, since the antenna 6 and the detecting circuit 7 are not directly mounted on the wall face of the heating chamber 1, temperature rise on the walls of the heating chamber 1 due to cooking is not readily transmitted thereto, with a favorable ventilation therearound, and thermal destruction of the parts constituting the detecting circuit 7 or influence over the temperature characteristic do not readily take place, thus making it possible to effect stable detection.

Since the antenna 6 is constituted by the patterns on the same substrate as that for the detecting circuit 7, extremely favorable dimensional accuracy may be achieved for stable matching with respect to the detecting circuit 7, with consequent reduction of scattering in the characteristics.

In the above construction, even in the actual cooking or in the worst operating condition, leakage power therearound is found to be less than $10mW/cm^2$ when such leakage power is measured by a leakage meter (i.e. a leakage wave measuring device not particularly shown), which is below 1/10 with respect to the part of the 1/10W rating, and thus, there is no excessive input to the detecting circuit, without generation of leakage power which may give rise to influence over human bodies or erroneous functioning.

In the printed circuit board for the embodiment of FIG. 4, although the Schottky barrier diode of 250mW rating, and other parts are employed, the chip component parts mainly employed are normally of rated power at 100mW to 500mW, with the rating values tending to be lowered as the temperature rises. In the high frequency heating apparatus, even if the wave leakage was less than 1/10 of the rated value in the actually mounted state, further investigation must be made through study of the actual temperature conditions and power consumption of each chip component part.

Figure 10:
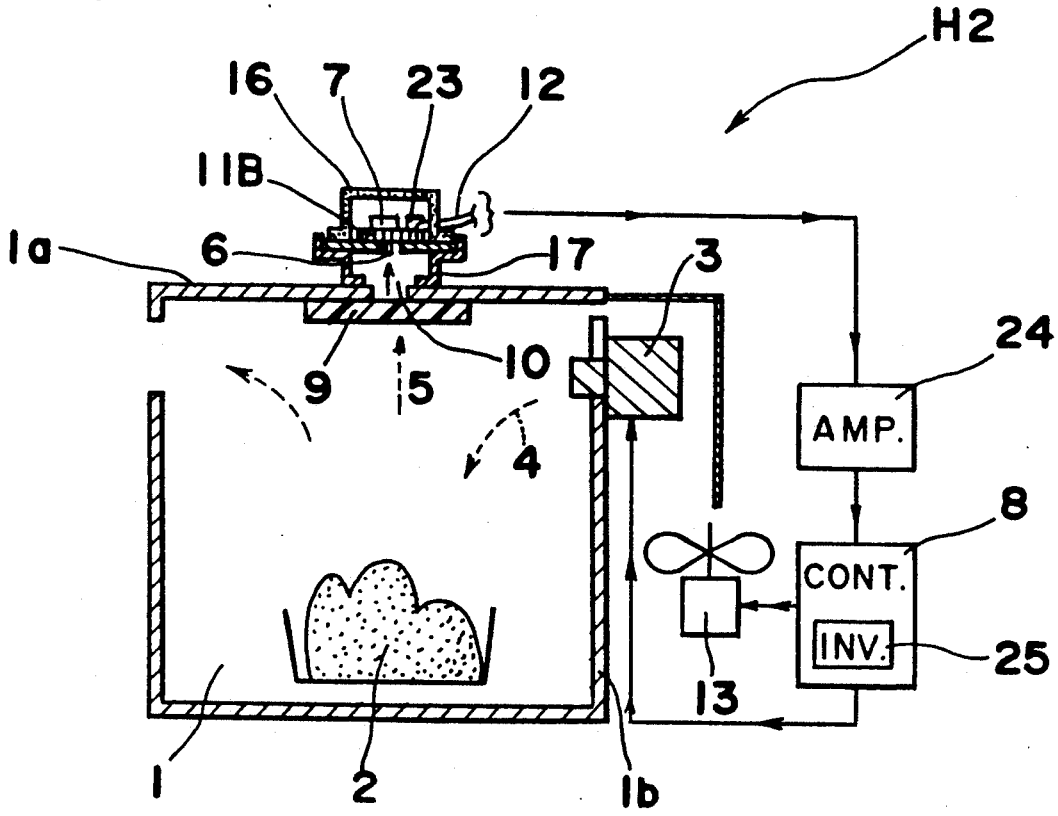
FIG. 10 is a schematic side sectional view of a high frequency heating apparatus according to another embodiment of the present invention.

Referring to FIG. 10, there is shown a high frequency heating apparatus H2 according to a second embodiment of the present invention. In FIG. 10, in addition to the arrangement for the high frequency heating apparatus H1 as described earlier with reference to FIG. 2, the high frequency heating apparatus H2 is so arranged to smooth the output of the detecting circuit 7 using a smoothing circuit 23, and an output of said smoothing circuit 23 is fed to an amplifying circuit 24 so as to be processed after having been converted into a voltage having a level which is easy to be control. Based on the signal after the amplification, the control section 8 gives instructions to an inverter power source 25 for controlling the microwave radiating section 3.

Figure 11:
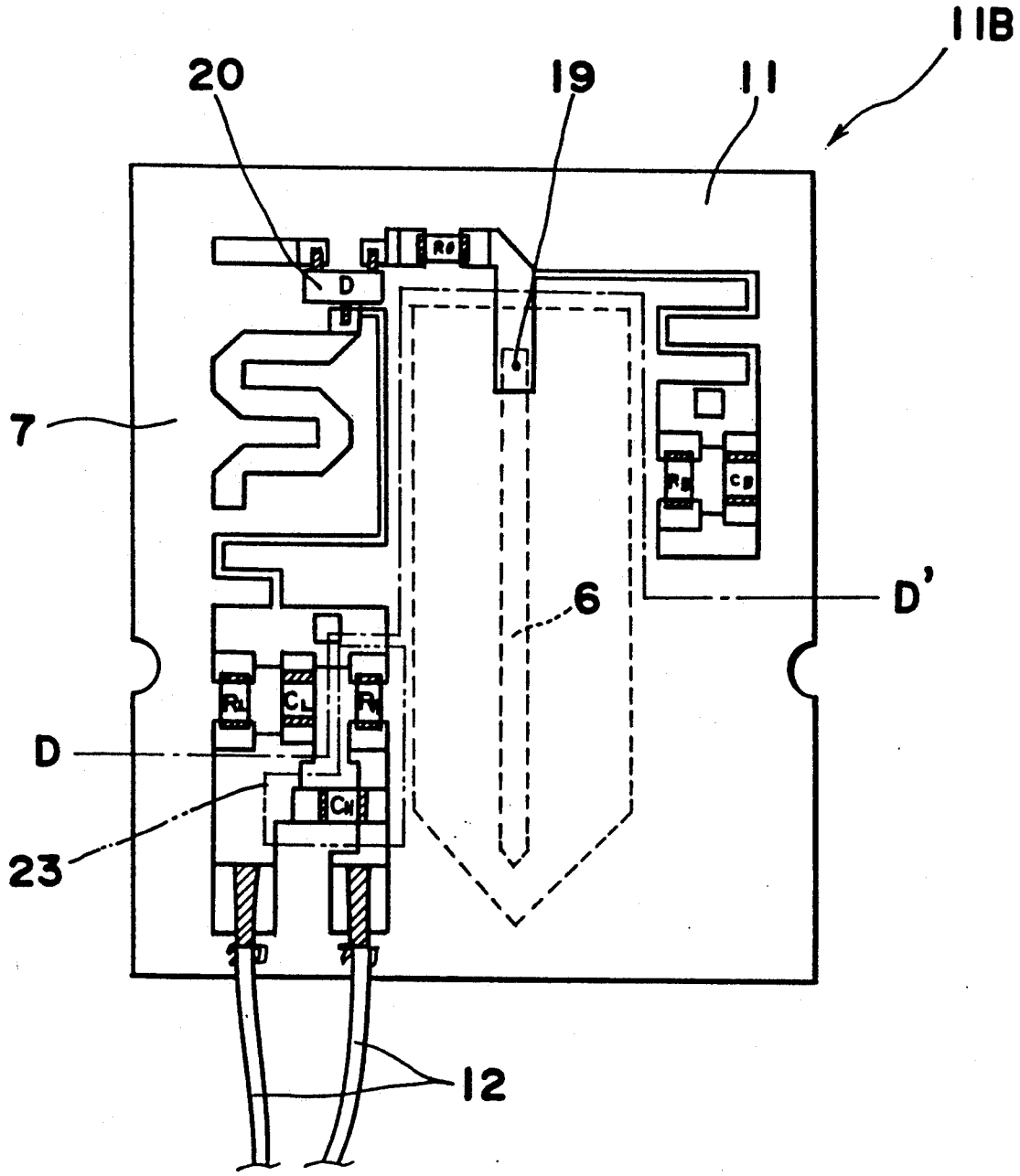
FIG. 11 is a view similar to FIG. 4, which particularly shows another embodiment thereof.

FIG. 11 shows one example of the printed circuit board 11B as employed in the above high frequency heating apparatus H2 of FIG. 10. Hereinbelow, the construction of the printed circuit board 11B will be explained to the arrangement of the printed circuit board 11 described earlier with reference to FIG. 4.

In FIG. 11, the microwaves transmitted through the antenna 6 constituted by the patterns on the reverse face of the substrate 11 (shown by dotted lines) are led into the detecting circuit 7 (i.e. the upper side portion from a line D—D' in FIG. 11) so as to be detected by said detecting circuit 7 constituted by the chip component parts such as the Schottky barrier diode 20, etc. and the micro-strip lines, and after being smoothed by the smoothing circuit 23 (surrounded by two-dotted lines), fed to the subsequent amplifying section 24 (FIG. 10) through the lead wires 12.

Figure 12:
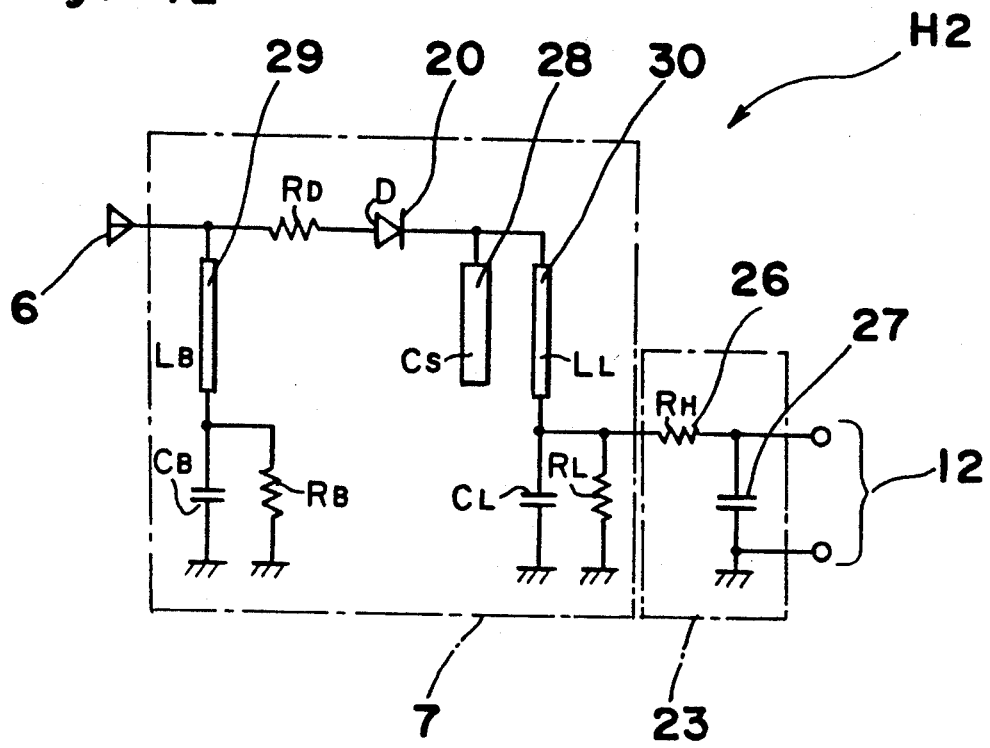
FIG. 12 is an equivalent circuit diagram showing constructions of the antenna, detecting circuit and smoothing circuit.

Reference is also made to FIG. 12 showing an equivalent circuit for the printed circuit board 11B of FIG. 11.

In FIG. 12, the antenna 6 is connected to a parallel connection of a capacitor $C_L$ and a resistor $R_L$ through a resistor $R_D$, the Schottky barrier diode 20 and micro-strip line 30, while a junction between the antenna 6 and the resistor $R_D$ is connected to a parallel connection of a capacitor $C_B$ and a resistor $R_B$ through a micro-strip line $L_B$ 29, and a junction between the diode 20 and the micro-strip line $L_L$ 30 is connected to the micro-strip line $C_S$ 28, thereby constituting said detecting circuit 7 as enclosed by the depicted one-dotted chain line. A junction between the micro-strip line 30 and the parallel connection of the capacitor $C_L$ and resistor $R_L$ is connected to one lead 12 through a resistor $R_H$ 26, with a junction between the resistor 26 and the lead 12 is connected to the other lead 12 and also to ground through a capacitor 27, and thus, the smoothing circuit 23 is formed.

As was also stated with reference to FIG. 11, the microwaves transmitted from the antenna 6 to the detecting circuit 7 are detected by the Schottky barrier diode 20, and smoothed by the smoothing circuit 23 constituted by the resistor 26, and capacitor 27, etc. so as to be fed to the subsequent process. In the above circuit construction, the micro-strip line $C_S$ 28 is so designed as to short-circuit to a ground potential an output of a frequency in the vicinity of the center frequency of the electromagnetic waves in the signal, and is thus considered to be a capacitor in terms of high frequency waves. Meanwhile, the micro-strip lines 29 and 30 are each designed so as not to transmit the output of the frequency in the vicinity of the center frequency of the electromagnetic waves to the subsequent stage, and is considered to be an inductance in terms of high frequency waves. However, since signals other than the center frequencies of the electromagnetic waves can not be removed by the microwave-strip lines 28,29 and 30 and are transmitted to the subsequent process, they are smoothed by the smoothing circuit 23. Due to the fact that the inverter power source 25 is particularly employed in the present embodiment, high frequency oscillation having switching frequencies (at 20 to 30 kHz in general) as an envelope is employed, and in order to remove abnormal switching frequencies, a cut-off frequency fc is set at about 13 kHz. Such states are shown in FIG. 13 and thereafter.

Figure 13:
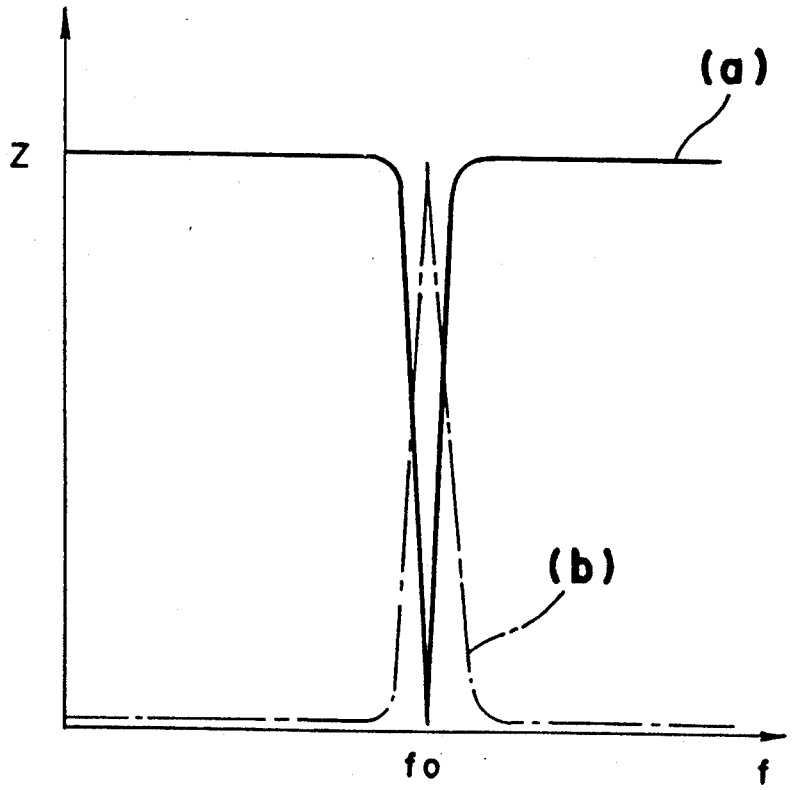
FIG. 13 is a frequency characteristic diagram of the impedance for the micro-strip line.

FIG. 13 shows the frequency characteristics of the impedance for the micro-strip lines 28, 29 and 30, with the impedance Z being plotted on the ordinate, and the frequency f, on the abscissa. In FIG. 13, a curve (a) relates to the micro-strip line 28, and the impedance approaches 0 in the vicinity of the center frequency fo of the electromagnetic wave. Meanwhile, another curve (b) relates to the micro-strip lines 29 and 30, and the impedance is substantially increased in the vicinity of fo. This diagram simultaneously shows that the impedance varies when the frequency is deviated due to the narrow band region of the micro-strip line, and thus, the smoothing circuit 23 is required at the subsequent stage.

Figure 14:
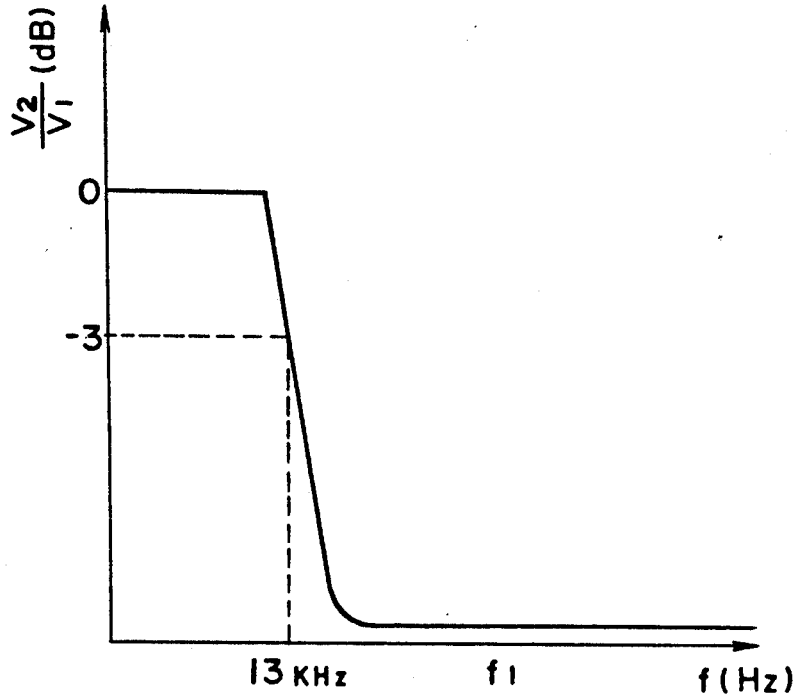
FIG. 14 is a filter characteristic diagram for a smoothing circuit, FIGS. 15(*a*) and 15(*b*) are characteristic diagrams of output waveforms according to the presence or absence of the smoothing circuit.

FIG. 14 shows a cut-off state of the smoothing circuit.

In FIG. 14, when the frequency f for the abscissa is low, a ratio V2/V1 of the input V1 to the output V2 of the smoothing circuit 23 for the ordinate is 0dB (i.e. to be completely passed), but upon rising of the frequency, the ratio V2/V1 falls significantly (i.e. to be cut off). According to one preferred embodiment of the present invention, the cut-off is −3dB at 13 kHz as described earlier, and the switching frequency f1(≈30kHz) of the inverter power source 25 and signals of frequencies thereabove are completely cut off.

Figure 15A:
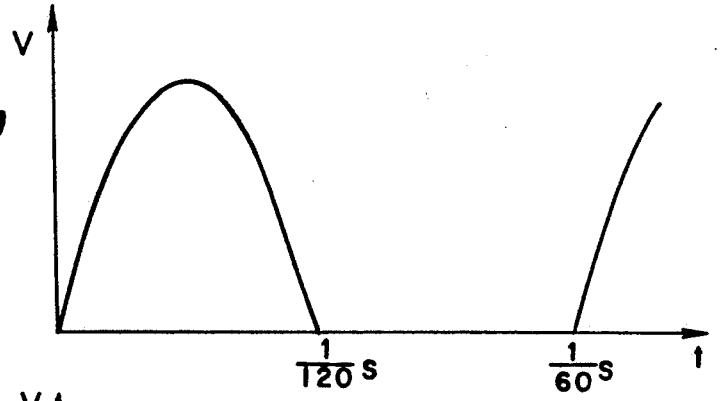
Figure 15B:
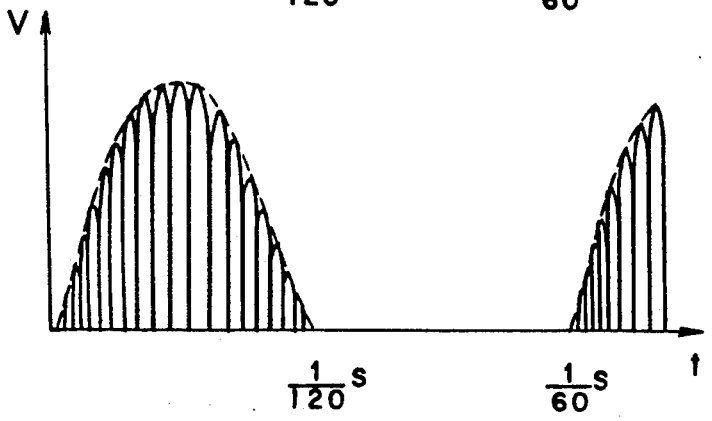

FIGS. 15(*a*) and 15(*b*) are graphical diagrams showing the output of the detecting circuit 7 as it is smoothed by the smoothing circuit 23, and not smoothed thereby, with the ordinate representing the output V of the detecting circuit 7, and the abscissa denoting time t.

In FIG. 15(*a*) related to the case where smoothing is effected, only the envelope for the commercial power source frequency (60Hz) remains.

Meanwhile, in FIG. 15(*b*), without smoothing, an oscillation of 30 kHz is noticed, with 60 Hz set as the envelope. According to the present invention, the smoothing circuit 23 is provided, and the frequency is lowered to the oscillation of a low frequency at 60 Hz.

Figure 16:
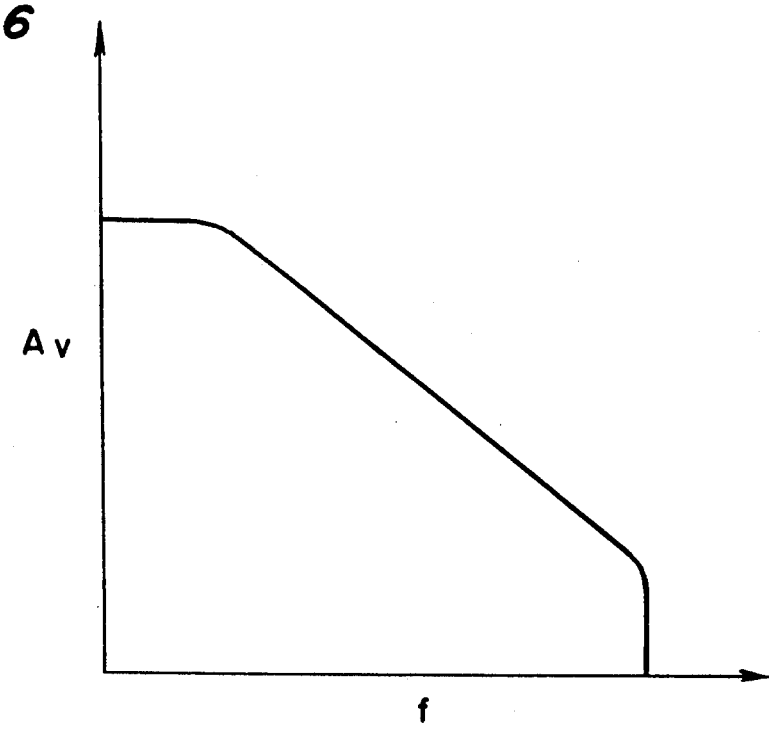
FIG. 16 is frequency characteristic diagram showing degrees of amplification of a general amplifier, FIG. 17(*a*) is a top plan view of an electromagnetic wave detector which may be employed in the high frequency heating apparatus of the present invention, FIG. 17(*b*) is a cross section taken along the line XVII(*b*)-XVII(*b*) in FIG. 17(*a*)

The frequency of the electromagnetic waves or microwaves as detected by the antenna 6 is equal to the oscillating frequency of the microwave radiating portion 3 having the power source frequency as the envelope, and the output as detected by the detecting circuit 7 assumes a rectified waveform containing a high frequency component, with an amplitude only in a positive direction. If the above output is fed to the amplifying section 24 at the subsequent stage as it is, there is such a disadvantage, as shown in FIG. 16, that the degree of amplification is lowered as the frequency is raised due to the frequency characteristic (the abscissa represents frequency f, and ordinate, open voltage gain Av) of the amplifying section 24 (i.e. general purpose operational amplifier), and the signal becomes unreliable. Moreover, if the output of the detecting circuit 7 containing the high frequency component is fed to the amplifying section 24 at the subsequent stage through lead wires and patterns in a round-about passage, noises tend to be picked up, with a consequent deterioration of the detecting accuracy. The favorable effect of the smoothing circuit 23 may be clearly understood even by the fact as described above.

Subsequently, the electromagnetic wave or microwave detector including the printed circuit board 11, metallic plate 14, and metallic cover 16 will be described in more detail with reference to FIGS. 17(*a*) and 17(*b*).

Figure 17A:
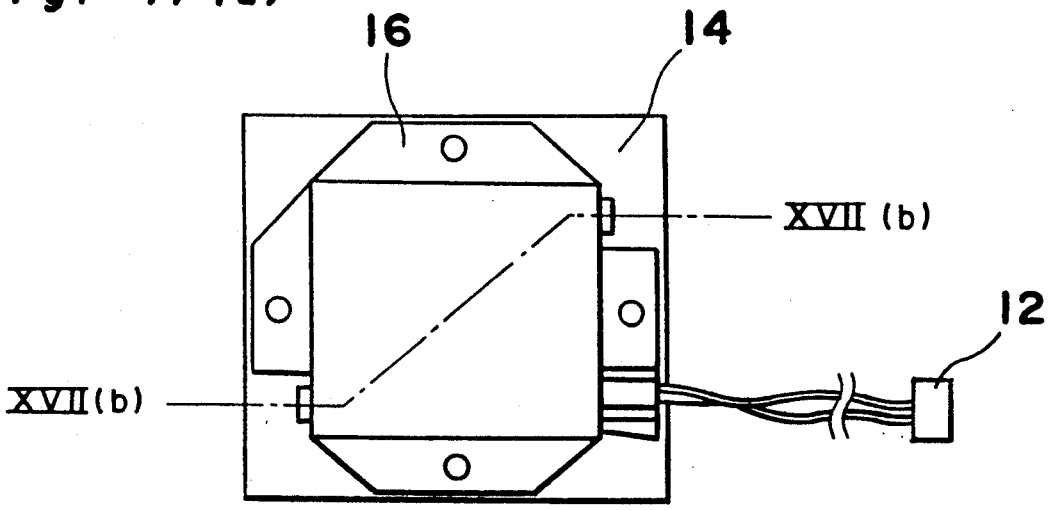
Figure 17B:
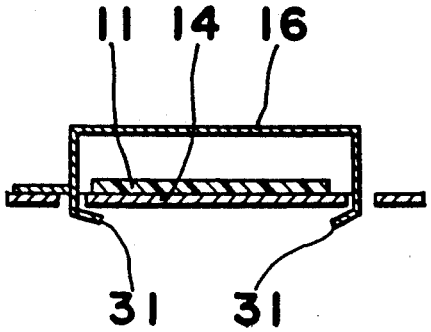

As is seen from a cross section of FIG. 17(*b*), in the electromagnetic wave detector having a top plan view as in FIG. 17(*a*), the metallic cover 16 is temporarily fixed to the metallic plate 14 by inserting claws 31 of said cover 16 into corresponding openings in said metallic plate 14 for subsequent folding of said claws 31, with the printed circuit board 11 (or 11B) being incorporated therebetween (FIG. 3). Such a electromagnetic wave detector may be moved to any place as a unit containing the lead wires 12 also, and has a sufficient resistance against noises. In the above construction, the printed circuit board may be prepared by a glass thermosetting material, fluoroplastic material or the like having a small high frequency loss, and formed with copper foil patterns on opposite faces. Reference is further made to an equivalent circuit of the detecting circuit 7 in FIG. 18.

Figure 18:
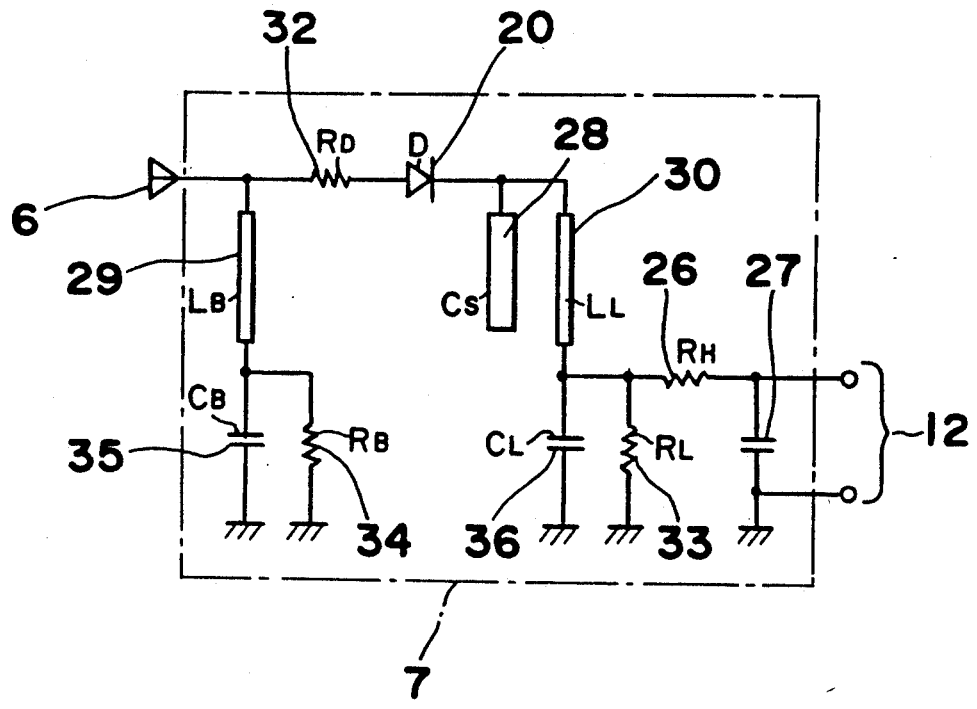
FIG. 18 is an equivalent circuit diagram for the detecting circuit and smoothing circuit.

In FIG. 18, the antenna 6 is connected to the parallel connection of the capacitor $C_L$ 36 and resistor $R_L$ 33 through a resistor $R_D$ 32, the Schottky barrier diode D 20 and micro-strip line $L_L$ 30, while the junction between the antenna 6 and the resistor $R_D$ 32 is connected to the parallel connection of the capacitor $C_B$ 35 and the resistor $R_B$ 34 through the micro-strip line $L_B$ 29, and the junction between the diode D 20 and the micro-strip line $L_L$ 30 is connected to the micro-strip line $C_S$ 28. The junction between the micro-strip line $L_L$ 30 and the parallel connection of the capacitor $C_L$ 36 and resistor $R_L$ 33 is connected to one lead 12 through the resistor $R_H$ 26, with the junction between the resistor $R_H$ 26 and the lead 12 being connected to the other lead 12 and also to ground through the capacitor 27.

Subsequently, the functioning of the detecting circuit 7 will be described with reference to FIG. 18 referred to above.

When the microwaves are directed from the antenna 6 into the detecting circuit 7, since it is so designed that, with respect to the center frequency of the microwaves, the micro-strip lines $L_B$ 29 and $L_L$ 30 become "open" (infinite impedance) for the subsequent parts, and the micro-strip line $C_S$ 28 is short-circuited to ground, the high frequency waves are grounded by the micro-strip line $C_S$ 28 through the resistor $R_D$ 32 and the Schottky barrier diode D 20. In this case, the output in the positive direction as rectified by the diode 20 flows through the load resistance $R_L$ 33 as D.C. current. For forming a D.C. closed loop, the same current also flows through the resistor $R_B$ 34, thus forming the loop as in $R_B \rightarrow R_D \rightarrow D \rightarrow R_L$. Thus, a half wave rectified waveform obtained by the current flowing through the load resistance is smoothed by the resistor $R_H$ 26 and capacitor 27 so as to be transmitted to the leads 12. By way of example, it is to be noted that the parts other than the micro-strip lines in the detecting circuit 7 are all chip component parts.

Hereinafter, the reason for providing the resistor $R_D$ 32 will be explained with reference to FIGS. 19 and 20. When an electromagnetic wave detector is employed for a high frequency heating apparatus, the amount of power to be detected by the antenna 6 and the detecting circuit 7 output are largely varied by the conditions of the food article to be placed in the heating chamber. By way of example, as shown in FIG. 19 in which the abscissa represents weight, and the ordinate denotes the detecting circuit 7 output, with the food article having a low initial temperature being represented by a curve (a), and that having a high initial temperature, by a curve (b), the variation extends from Vs min to Vs max.

Figure 19:
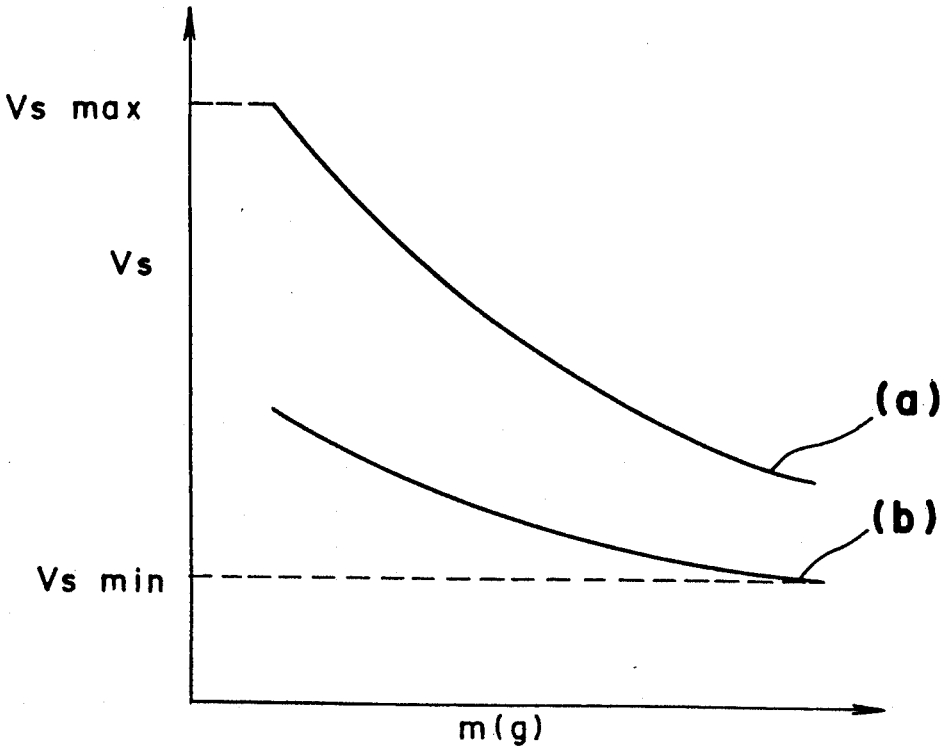
FIG. 19 is a characteristic diagram showing a relation between food article weights and detecting circuit outputs.
Figure 20:
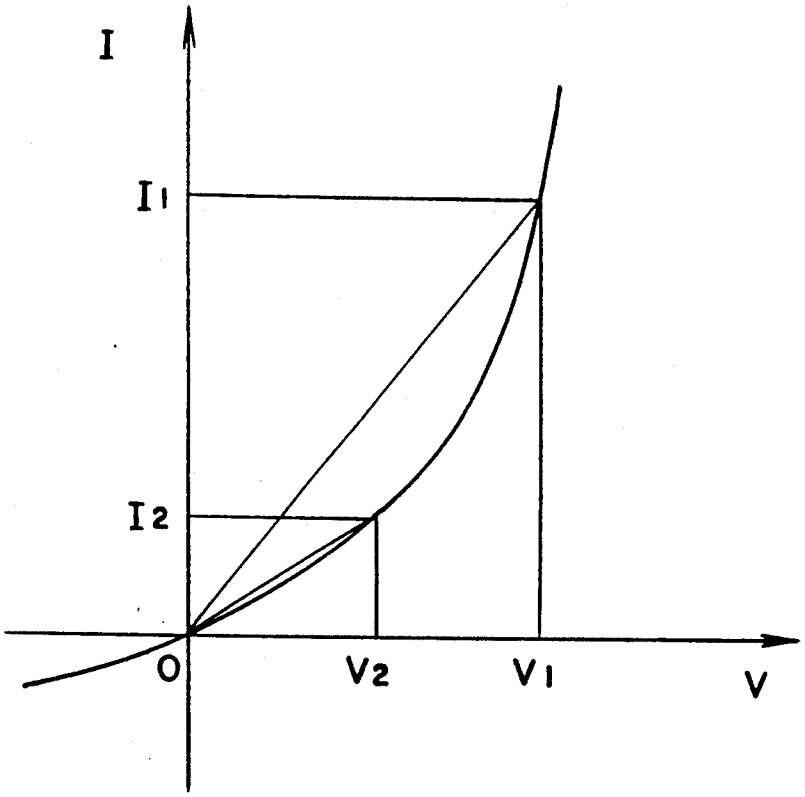
FIG. 20 is a voltage-current characteristic diagram for the diode, FIGS. 21(*a*),21(*b*) and 21(*c*) are respectively construction diagrams for micro-strip lines, FIGS. 22(*a*),22(*b*) and 22(*c*) are time-charts showing a functioning of the detecting circuit.

FIG. 20 shows voltage-current characteristics of the Schottky barrier diode 20, and in this case, on the assumption that the resistor $R_D$ 32 (connected in series with the Schottky barrier diode 20) is absent for functioning in a range between 0 and $V_1$ in FIG. 20, the sensitivity (variation rate or inclination) in the vicinity of $V_1$ substantially differs from that in the vicinity of 0, and thus, judgement without a linearity is made such that a light load as shown in FIG. 19 is easily detected, but the sensitivity is low with respect to a heavy load. On the other hand, when it is so arranged to lose some of the electric power at the resistor $R_D$ 32 by the insertion thereof, the Schottky barrier diode 20 becomes to function in the range between 0 and V2, and a large linearity may be imparted as compared with the case where the resistor $R_D$ 32 is not present.

Subsequently, the micro-strip lines referred to earlier with reference to FIG. 18 will be explained.

Figure 21A:
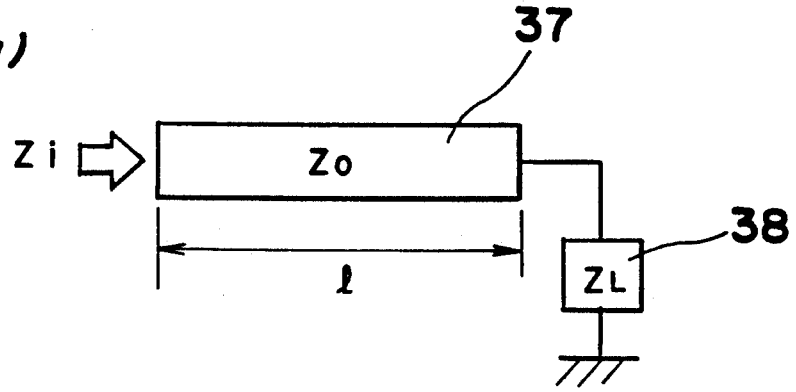
Figure 21B:
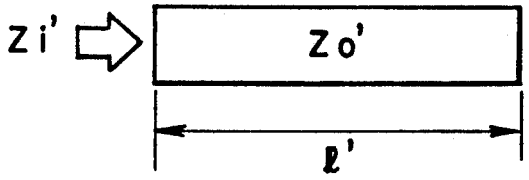
Figure 21C:
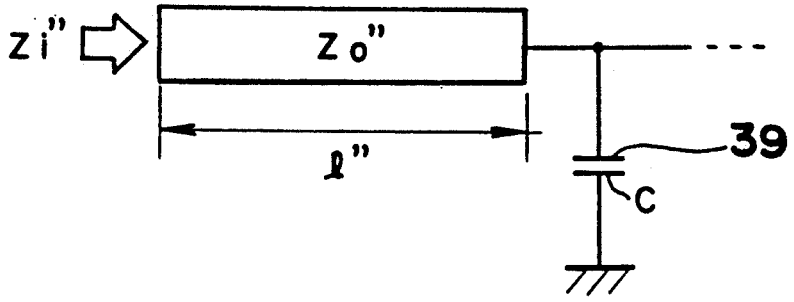

FIG. 21(*a*) shows a case where a load impedance $Z_L$ 38 is connected to a micro-strip line 37 having a length l with a characteristic impedance Zo. In this case, the impedance Zi is generally represented by $$\left.\begin{aligned} Zi &= Zo\frac{Z_L + jZ_o\tan\beta l}{Z_o + jZ_L\tan\beta l} \\ \beta &= \left[\frac{2\pi}{\lambda g}\right] \end{aligned}\right\} \quad (1)$$

where λg represents a wavelength on the substrate.

When the relation of the equation (1) is applied to FIG. 18, the micro-strip line $C_S$ 28 is of a so-called open-stub type not connected with a load impedance as represented by FIG. 21(*b*). In this case, if the equation (1) is simplified by setting $$Z_L' = \infty,\ Zi = -j\,Z_o'\cot\beta l$$

and since the pattern length l is set to be equal to $$\frac{\lambda g}{4},$$

the relation will be $$Zi' = jZ_o'\cot\frac{\pi}{2} = 0$$

In other words, the state of short-circuiting is established in terms of high frequency waves.

Meanwhile, the micro-strip lines $L_B$ 29 and $L_L$ 30, etc. in FIG. 18 may be considered as in FIG. 21(*c*), and when capacitors having a large capacitance to a certain extent are selected for the capacitors $C_B$ 35 and $C_L$ 36 (or the capacitor C39 of FIG. 21), the load impedance $$Z_L = \frac{1}{j\omega C}$$

approaches 0, and the resistor, etc. connected in parallel thereto may be neglected. In other words, the equation (1) may be simplified as follows by setting $$Z_L = 0,\ Zi'' = jZ_o\tan\beta l$$

and since the pattern length l is selected to be $$\frac{\lambda g}{4},$$

the relation will be $$Zi'' = jZ_o\tan\frac{\pi}{2} = \infty$$

i.e. to be "open" in terms of high frequency waves.

Thus, the function referred to earlier with reference to FIG. 18 is realized, so that the high frequency waves are not transmitted toward the side of the load resistance $R_L$.

Here, characteristics of the detecting circuit 7 will described with reference to the time-charts of FIGS. 22(*a*), 22(*b*) and 22(*c*) showing the functioning of the detecting circuit 7.

Figure 22A:
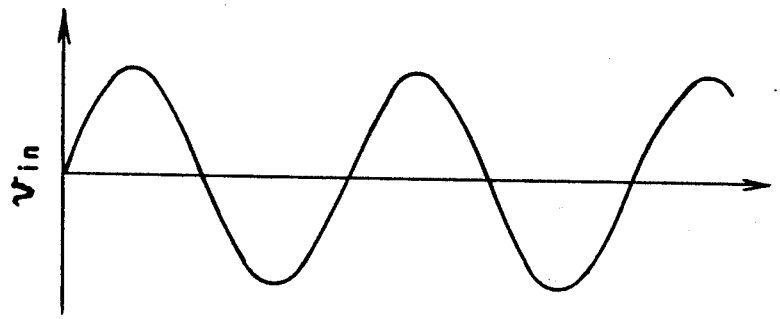
Figure 22B:
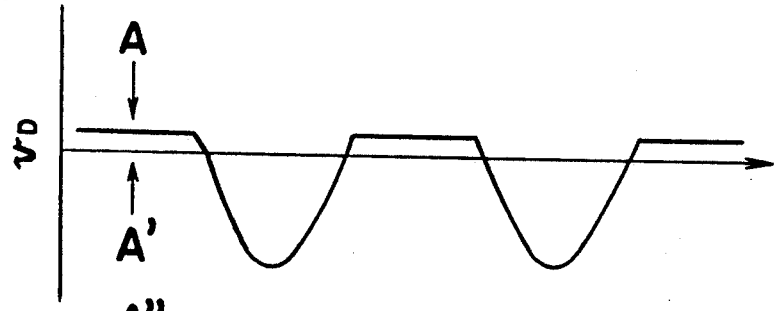
Figure 22C:
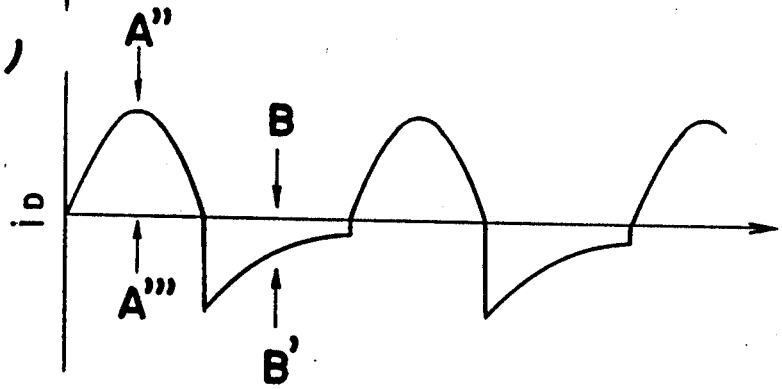

When the input Vin from the antenna 6 is of a sine wave voltage as shown in FIG. 22(*a*), the voltage $V_D$ applied to the Schottky barrier diode 20 will be as shown in FIG. 22(*b*), and a voltage component determined by a forward voltage $V_F$ as in between A—A' in the forward direction remains. Such a voltage component becomes large as the forward voltage $V_F$ increases, and varies according to the temperature characteristic of said voltage $V_F$. Meanwhile, the current $i_D$ flowing through the Schottky barrier diode 20 will become as shown in FIG. 22(*c*), and in the positive direction, the current between A''—A''' increasing and decreasing according to the temperature rise of the forward voltage $V_F$ flows. On the other hand, in the negative direction, as shown between B—B', the current component determined by the reverse restoration time trr remains during the high frequency wave period. Such a current component increases as the time trr increases, and varies to correspond to the temperature characteristics of the time trr. In other words, it is indicated that the rectifying function is lost as the forward voltage $V_F$ and the reverse restoration time trr become larger. Accordingly, it is seen that employment of the Schottky barrier diode having a smaller forward voltage $V_F$ and the reverse recovery time trr than a fast recovery diode is more effective.

Figure 23:
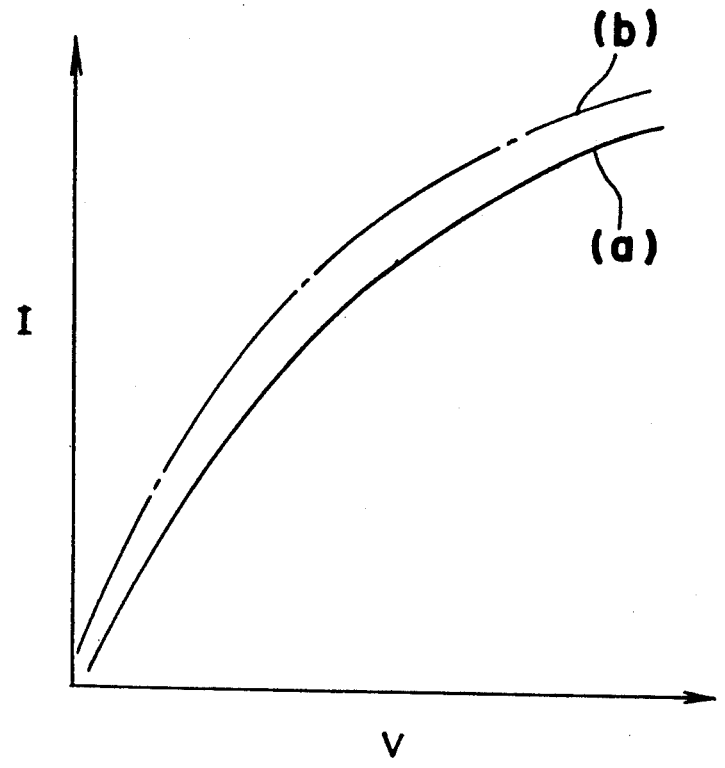
FIG. 23 is a forward direction voltage-current characteristic diagram for a Schottky barrier diode.

Reference is made to FIG. 23 showing $V_F-I_F$ characteristics (i.e. forward direction voltage—current characteristic) of the Schottky barrier diode, in which a curve (a) represents the characteristic at normal temperature, while another curve (b) denotes the characteristic at high temperature. From the diagram of FIG. 23, it is seen that the voltage when the same current is following is reduced by the temperature rise (in, other words, the current when the same voltage is being applied is increased by the temperature rise), with the variation rate in the low voltage range being particularly large.

Figure 24:
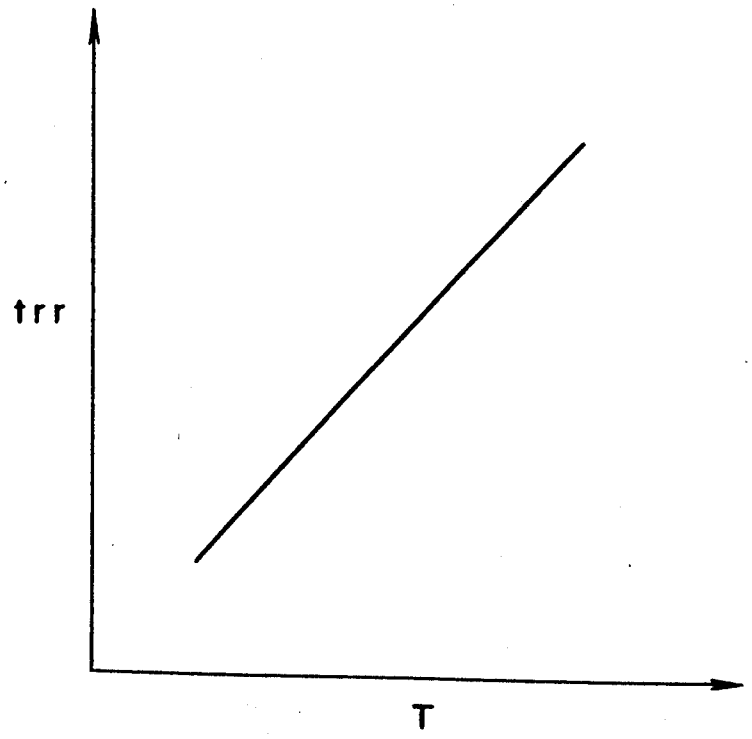
FIG. 24 is a temperature characteristic diagram of reverse recovery time of the Schottky barrier diode.

FIG. 24 shows the temperature characteristics of the reverse restoration time trr for the Schottky barrier diode, from which it is observed that the reverse restoration time trr of the ordinate is increased as the temperature T of the abscissa is raised.

Figure 25:
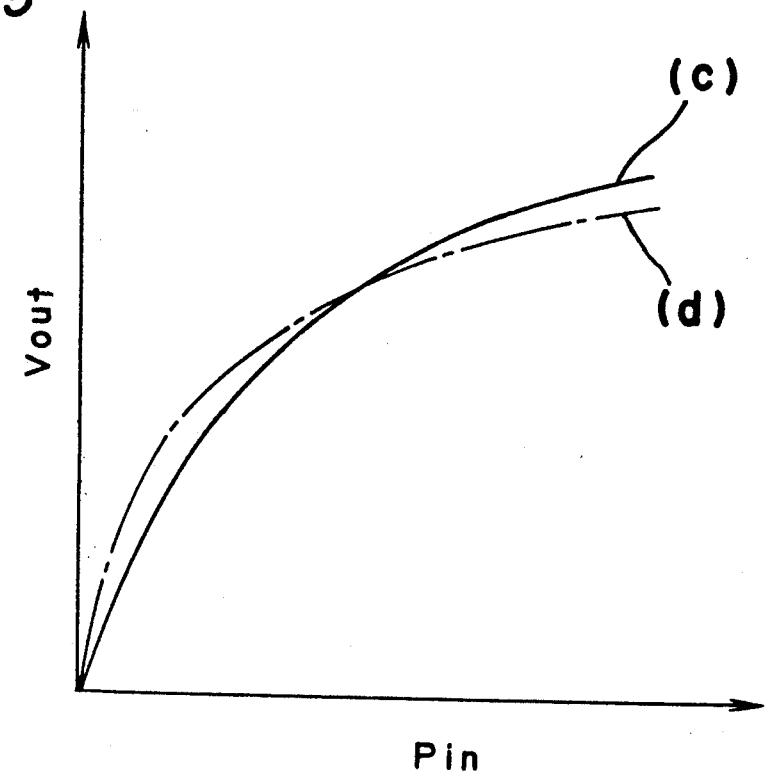
FIG. 25 is an input/output characteristic diagram for the detecting circuit.
Figure 26:
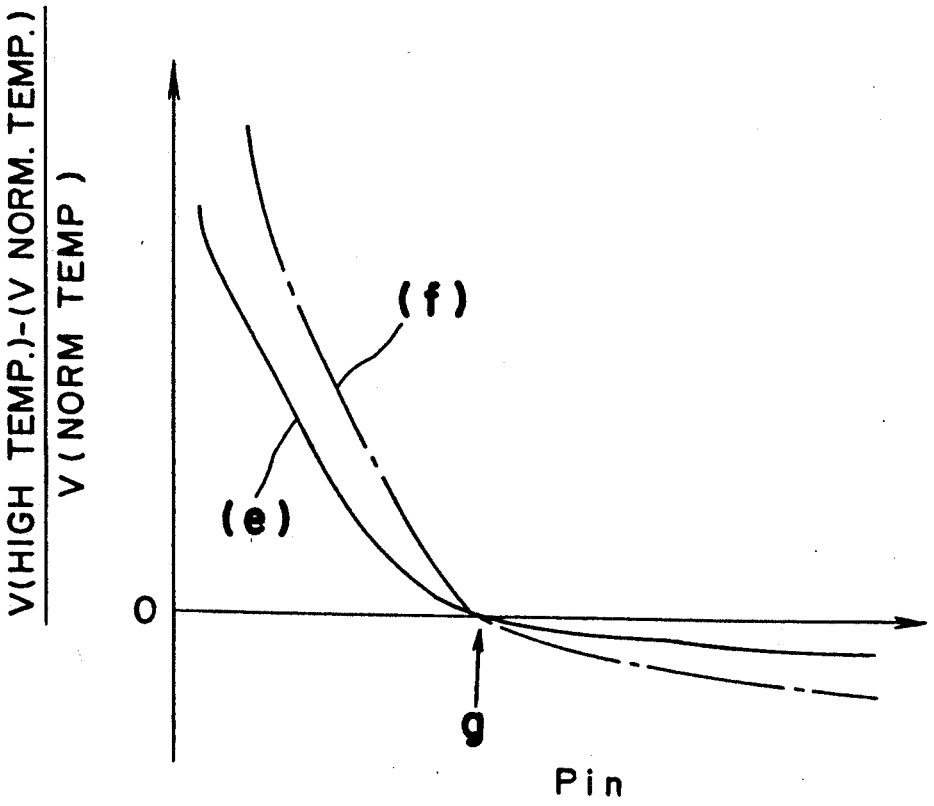
FIG. 26 is a characteristic diagram showing a variation rate of output by temperatures with respect to the input of the detecting circuit.

From the characteristics of FIGS. 22 to 24 as described so far, the input/output characteristics of the detecting circuit 7 will become as shown in FIG. 25, in which the abscissa represents incident power Pin as detected by the antenna 6, and the ordinate denotes the average output Vout of the detecting circuit at that time, with the characteristic at normal temperature being represented by (c), and the characteristic at high temperature b (d). In other words, by the temperature rise, during the low input period, the output increases since the positive current increases due to the characteristic of the forward voltage $V_F$, while during the high input period, the output is reduced, since the reverse direction current by trr is increased, although the variation due to the forward voltage $V_F$ is reduced. The above fact will be represented as in FIG. 26, when formed into a graphical form as the variation rate of outputs during normal temperature and high temperature. In FIG. 26, the abscissa represents incident power Pin, and the ordinate denotes the variation rate as obtained by dividing the difference between the output at high temperature and the output at normal temperature by the output at normal temperature. A symbol (e) represents a diode having small temperature characteristics for $V_F$ and trr (e.g. the Schottky barrier diode), while a symbol (f) denotes a diode with large temperature characteristics for $V_F$ and trr (e.g. fast recovery diode).

With respect to a high frequency heating apparatus having a rapid temperature rise due to repeated cooking, etc , it is clear that the Schottky barrier diode is more preferable in order to maintain the detection accuracy. It is to be noted that from the viewpoint of designing, the range for using the detecting circuit is set to be in the vicinity of a point g in the diagram of FIG. 26.

By the arrangement according to the present invention as described so far, favorable effects as follows may be obtained.

(1) Since the antenna is mounted at the top wall portion of the heating chamber, microwaves within the heating chamber may be most effectively detected on the whole without depending on the positions where the food article is placed, and thus, an extremely stable cooked state may be achieved. Furthermore, particularly in a less expensive high frequency heating apparatus for general family use, the microwave radiating portion and suction/exhaust port, etc. are provided at the side wall of the heating chamber in many cases, and by the above construction of the present invention, the antenna is not readily affected by heat and noises of the microwave radiating portion and hot air from the exhaust port, etc., thereby to realize the detection at high reliability.

(2) Owing to the construction that the antenna is provided in the vicinity of an opening formed in the top wall of the heating chamber instead of being disposed within said heating chamber, temperature rise due to concentration of microwaves onto the antenna itself or excessive input to the detecting circuit, etc. may be suppressed for detecting at high dependability, while obstruction or danger to a user by the antenna protruding into the heating chamber may be prevented.

(3) Since the power leakage in the vicinity of the opening, antenna and detecting circuit is reduced to less than 1/10 of the rated power of the parts constituting the detecting circuit, over-input to the detecting circuit may be prevented, and therefore, constituting parts are not readily damaged for improved reliability, while influence over human bodies is eliminated for safety, and moreover, there is no possibility that the leakage power causes noises or malfunction in the functioning of the external appliances.

(4) By the arrangement to smooth the output of the detecting circuit, it is possible to send the signal to the amplifier at the next stage after suppressing the high frequency wave component left in the rectified waveform of the microwaves detected by the antenna, and therefore, influence over the frequency characteristic of the amplifier can be prevented, and stable signal detection and signal processing are possible irrespective of variations of the oscillating frequency of the microwave radiating portion for detection at higher reliability.

(5) Due the employment of the inverter power source, the detecting circuit output has the oscillation of the switching frequency in the envelope of the power source frequency, the signal tends to easily pick up noises or to readily generate noises undesirably. Accordingly, besides the effect referred to in the above item (4), since the switching frequency may be suppressed by the provision of the smoothing circuit noise factor may be excluded for extremely stable detection.

(6) Since the detecting circuit is constituted by the micro-strip lines and chip component parts, it is easy to prevent high frequency waves from being transmitted to the circuitry after the diode, and thus, adverse effects to the matched state by the way of attaching chip component parts in such circuitry after the diode can be suppressed as far as possible. Thus, unnecessary high frequency loss at the chip component parts may be suppressed, while the characteristic of the detecting circuit becomes very stable for extremely accurate detection, since no high frequency waves are carried by the detecting output.

(7) As the chip resistance is connected in series to the detecting diode, the linearity of the input/output characteristics of the detecting circuit is increased, thus making it possible to detect at stable accuracy irrespective of the state of the food article.

(8) Since the open-stub micro-strip line short-circuited to ground with respect to the center frequency of the electromagnetic waves to be detected is provided at the output side of the detecting diode, the high frequency waves are consumed at the open-stub portion so as not to be transmitted to the subsequent stage, the effect as in the item (6) referred to above may be obtained.

(9) Since the Schottky barrier diode is employed as the detecting element, variation of the detecting output due to the temperature characteristics of the forward voltage $V_F$ and reverse recovery time trr is small for effecting extremely stable detection. Moreover, the rectifying function is superior since trr is small for good input and output sensitivity and a large output may be achieved even if the detecting amount at the antenna is reduced. More specifically, for obtaining the output of the same level, since the leakage waves toward the surrounding portion can be reduced as well as the detecting amount of the antenna, noise generation for external appliances may be decreased to eliminate the factors for erroneous functioning, while the apparatus is safe for the user with high reliability.

(10) As the antenna and the detecting circuit including the micro-strip lines and chip component parts are constructed on the same substrate, extremely stable matching is achieved between the antenna and the detecting circuit for detection of electromagnetic waves at high accuracy.

(11) Since the chip resistance is connected in series to the detecting diode, the linearity of the input/output characteristics for the detecting circuit is increased, thereby making it possible to effect the detection at stable accuracy without depending on the input level.

(12) As also stated in the above items (8) and (6), in another aspect of the present invention, the open-stub micro-strip line short-circuited to ground with respect to the center frequency of the electromagnetic waves to be detected is provided at the output side of the detecting diode, the high frequency waves are consumed at the open-stub portion so as not to be transmitted to the subsequent stage, and accordingly, adverse effects to the matched state by the way of attaching chip component parts in such circuitry after the diode can be suppressed as far as possible. Therefore, unnecessary high frequency loss at the chip component parts may be suppressed, while the characteristic of the detecting circuit becomes very stable for extremely accurate detection, since no high frequency waves are carried by the detecting output.

(13) As was also stated in the above item (9), in a further aspect of the present invention, as the Schottky barrier diode is employed as the detecting element, variation of the detecting output due to the temperature characteristics of the forward voltage $V_F$ and reverse recovery time trr is small for effecting extremely stable detection. Moreover, the rectifying function is superior since trr is small for good input and output sensitivity and a large output may be achieved even if the detecting amount at the antenna is small.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A high frequency heating apparatus comprising:

a heating chamber having an inner top wall, an inner bottom wall, and inner side walls, said inner bottom wall for resting a food article thereon;

microwave generating means for generating microwave energy for heating the food article within said chamber;

an aperture in said inner top wall for passing said microwave energy therethrough;

a receiving antenna means, located in close vicinity to said aperture and external of said heating chamber, for receiving a center frequency of said microwave energy passing through said aperture;

a detecting circuit, coupled to said receiving antenna means, for detecting an amount of said microwave energy received by said receiving antenna means; and, control means, coupled to said detecting circuit, for controlling operating functions of the high frequency heating apparatus in accordance with said amount of said microwave energy detected by said detecting circuit.

2. A high frequency heating apparatus as recited in claim 1 wherein said control means is further for determining a thawing state of a food article based on said amount of said microwave energy detected by said detecting circuit.

3. A high frequency heating apparatus as recited in claim 2, wherein said microwave generating means includes a microwave radiator located at one of said inner side walls of said chamber.

4. A high frequency heating apparatus as recited in claim 3, further comprising a substrate member having opposite first and second surfaces, said first surface confronting said aperture and having said receiving antenna means disposed thereon, said second surface having said detecting circuit disposed thereon.

5. A high frequency heating apparatus as recited in claim 4, further comprising a smoothing circuit, operatively interposed between said detecting circuit and said control means and disposed on said second surface of said substrate member, for smoothing an output of said detecting circuit.

6. A high frequency heating apparatus as recited in claim 1, wherein said microwave generating means includes a microwave radiator located at one of said inner side walls of said chamber.

7. A high frequency heating apparatus as recited in claim 1, further comprising a substrate member having opposite first and second surfaces, said first surface confronting said aperture and having said receiving antenna means disposed thereon, said second surface having said detecting circuit disposed thereon.

8. A high frequency heating apparatus as recited in claim 7, wherein a microwave energy in a vicinity of said receiving antenna means and said detecting circuit is less than 1/10 of a rated power of component parts constituting said detecting circuit.

9. A high frequency heating apparatus as recited in claim 7, further comprising a smoothing circuit, operatively interposed between said detecting circuit and said control means and disposed on said second surface of said substrate member, for smoothing an output of said detecting circuit.

10. A high frequency heating apparatus as recited in claim 7, wherein said detecting circuit comprises plural micro-strip lines and plural chip component parts including a detecting diode which is operatively coupled to said receiving antenna means.

11. A high frequency heating apparatus as recited in claim 10, wherein a microwave energy in a vicinity of said receiving antenna means and said detecting circuit is less than 1/10 of a rated power of component parts constituting said detecting circuit.

12. A high frequency heating apparatus as recited in claim 10, wherein said detecting diode is a chip component Schottky barrier diode.

13. A high frequency heating apparatus as recited in claim 12, further comprising a chip component resistance connected in series with said receiving antenna means and said detecting diode.

14. A high frequency heating apparatus as recited in claim 12, wherein one of said plural microstrip lines is an open-stub micro-strip line which short-circuits to ground with respect to a center frequency of said microwave energy and which is connected to an output side of said detecting diode.

15. A high frequency heating apparatus as recited in claim 1, wherein said detecting circuit comprises plural micro-strip lines and plural chip component parts including a detecting diode which is operatively coupled to said receiving antenna means.

16. A high frequency heating apparatus as recited in claim 15, wherein said detecting diode is a chip component Schottky barrier diode.

17. A high frequency heating apparatus as recited in claim 15, further comprising a chip component resistance connected in series with said receiving antenna means and said detecting diode.

18. A high frequency heating apparatus as recited in claim 15, wherein one of said plural microstrip lines is an open-stub micro-strip line which short-circuits to ground with respect to a center frequency of said microwave energy and which is connected to an output side of said detecting diode.

19. A high frequency heating apparatus as recited in claim 1, wherein said detecting circuit comprises a chip component Schottky barrier diode.

20. A high frequency heating apparatus as recited in claim 1, wherein a microwave energy in a vicinity of said receiving antenna means and said detecting circuit is less than 1/10 of a rated power of component parts constituting said detecting circuit.

* * * * *